United States Patent [19]

Sholtis et al.

[11] Patent Number: 4,627,754

[45] Date of Patent: Dec. 9, 1986

[54] DRUM CLAMPING MECHANISM FOR A PRINTER

[75] Inventors: Albert A. Sholtis, Long Beach; Jon S. Guy, Garden Grove, both of Calif.

[73] Assignee: Sanders Associates, Inc., Nashua, N.H.

[21] Appl. No.: 765,078

[22] Filed: Aug. 13, 1985

[51] Int. Cl.[4] ..... B41F 21/04; B41J 11/04

[52] U.S. Cl. ..... 400/649; 400/527.2; 400/659; 101/409

[58] Field of Search ..... 101/409, 408, 407 R, 101/415.1; 400/527.2, 240.3, 649, 659; 242/74.1, 74.2

[56] References Cited

U.S. PATENT DOCUMENTS

| | | | |
|---|---|---|---|
| 1,508,951 | 9/1924 | Baker | 101/409 X |
| 2,056,922 | 10/1936 | Gegenheimer | 101/409 X |
| 2,865,289 | 12/1958 | Fowlie et al. | 101/409 |
| 3,221,652 | 12/1965 | Mestre | 101/409 X |
| 4,388,628 | 6/1983 | Moriguchi et al. | 101/174 X |
| 4,543,004 | 9/1985 | Brandenburg et al. | 400/527.2 X |

OTHER PUBLICATIONS

Barber, Jr. et al., "Mechanism and Actuator for Clamping Sheets on a Drum", *IBM Technical Disclosure Bulletin*, vol. 23, No. 7A, Dec. 1980, pp. 2679–2682.

*Primary Examiner*—Clifford D. Crowder
*Attorney, Agent, or Firm*—Louis Etlinger; Wm. F. Porter, Jr.

[57] ABSTRACT

A mechanism for clamping the leading edge of a sheet to be wrapped around a printing drum for printing in a plurality of colors includes a clip that is movably mounted in the drum so that it can be moved between an open position and a clamping position, the clip being biased to its clamping position. One or more deflectable cams are positioned adjacent to the drum for engagement by the clip. When the drum is rotated in its direction for printing successive colors on the sheet, the clip deflects the cam and remains in its clamping position. However, when the drum is rotated in the opposite direction to discharge a printed sheet, the clip is engaged by the cams and wedged thereby to its open position thereby releasing the printed sheet. The mechanism also includes provision for automatically discharging the printed sheet from the drum to a discharge path adjacent to the drum when the clip is opened.

12 Claims, 5 Drawing Figures

FIG. 1
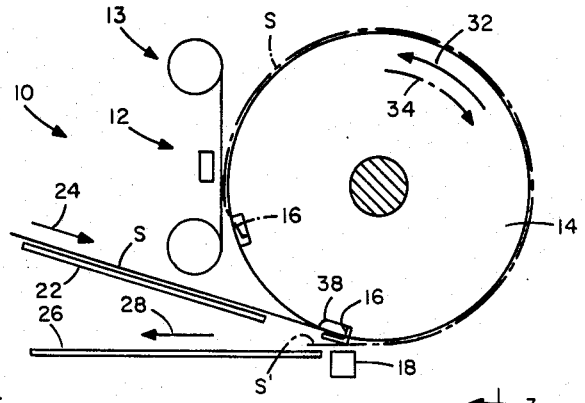
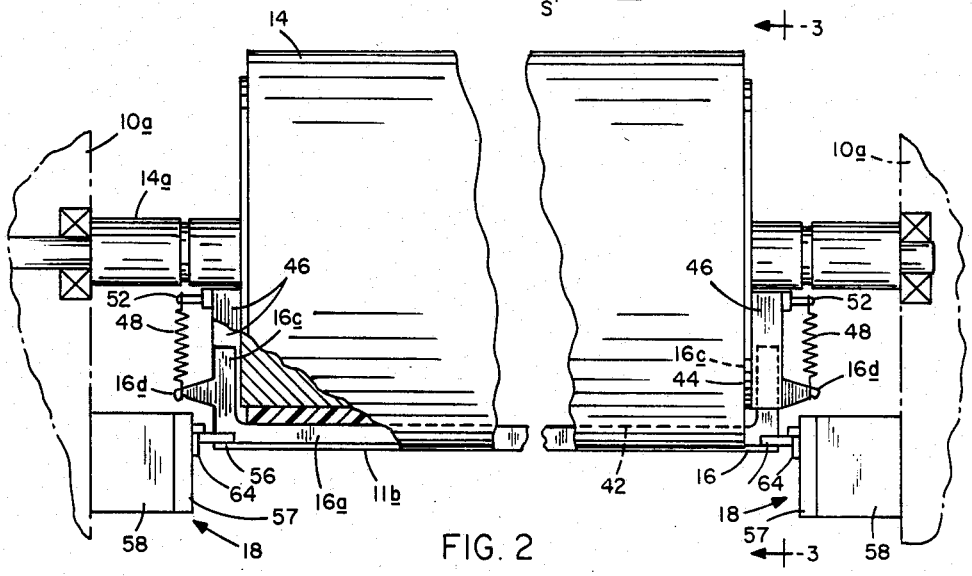
FIG. 2
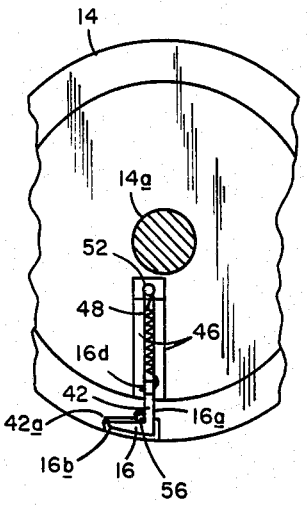
FIG. 3
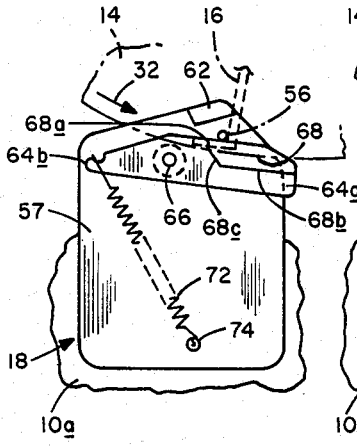
FIG. 4A
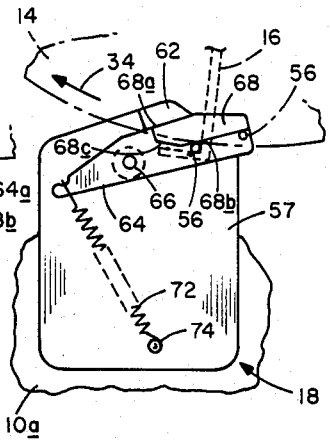
FIG. 4B

DRUM CLAMPING MECHANISM FOR A PRINTER

The present invention relates generally to a printer for printing in color on individual paper sheets fed by a sheet feeder to a rotatable drum which rotates the sheet past a plural-color print head a plurality of times in the same direction and then reverses direction to release and eject the printed sheet. It relates more particularly to an improved drum clamping mechanism which automatically receives and clamps each successive paper sheet to the drum for printing in one or more colors and then ejects the printed sheet from the drum prior to receiving and clamping the next sheet to the drum.

BACKGROUND OF THE INVENTION

Various types of clips and clamps have been employed in the past to releasably attach the leading edge of a flexible sheet or web to a rotary roll or drum so that the sheet or web is wrapped about the roll when the roll is rotated. Such mechanisms have been incorporated into the rolls of duplicating machines, printers and diverse winding apparatus. For example, U.S. Pat. No. 4,388,628 discloses a thermal transfer recorder for printing on a recording sheet. The leading edge of the recording sheet is attached to the roll, apparently manually, by means of a clip and the roll is rotated to wrap the sheet about the roll. During successive rotation cycles of the roll, subtractive color inks are applied to the sheet in register to form color printing thereon. Following completion of the printing operation, stripper fingers strip the printed sheet from the roll. However, no mechanism is disclosed there for opening and closing the clip at the beginning and end of each printing operation.

U.S. Pat. No. 4,346,856 discloses a device for rewinding material delivered in sheets in a heliographic machine or the like. That device includes a hollow rotary casing provided with a longitudinal slit. The casing is rotatively mounted on a driven shaft provided with radially-extending tabs along its length. The casing remains stationary until the leading edge of the sheet of material to be wound is inserted into the casing slot. As soon as the insertion takes place, the tabs on the internal driven shaft press that edge against a slotted plate on the inside wall of the casing, thereby clamping that edge to the casing while at the same time pulling around the casing so that the sheet is wound about the casing. After the driven shaft is stopped, the casing is temporarily removed from the shaft and the roll slid endwise from the casing. Thus, this type of device clamps the sheet only when there is relative rotation between the internal shaft and the casing. It is basically an inertial device whose clamping action bears no particular relationship to the angular position of the casing.

U.S. Pat. No. 1,870,243 shows a rotary winding block for winding strips of sheet material. This block also relies on relative motion between the block and an internal shaft to clamp the leading edge of the sheet to the block. Therefore, its clamping action is not dependent upon the angular position of the block.

Finally, U.S. Pat. No. 4,199,116 discloses a coiler or winder incorporating a roll around which strips of sheet material are wound. The roll includes an internal gripper bar extending the length of the roll which is accessible through a lengthwise slot in the roll wall. When the leading edge of the sheet material is inserted into the slot, it is clamped in place by the operator turning the gripping bar manually by means of a tab on the end of the bar. When the roll is rotated, the sheet material is coiled about the roll. When coiling is completed, a trip member positioned adjacent the roll is actuated so that, when the roll revolves to a selected angular position, the tab is engaged by the trip member, thereby rotating the gripper bar to its release position so that the coil of sheet material can be slid axially from the roll. Thus, in this clamping mechanism, no provision is made for automatically clamping the leading edge of the sheet material to the roll. Also, the roll only rotates in a sheet-material winding direction and the sheet material is released or unclamped when the roll is rotating in that same direction. Another clamping mechanism of this general type is disclosed in the old U.S. Pat. No. 297,739.

Thus, the prior devices for clamping or clipping sheet material to rotatable rolls and drums are not satisfactory for use in present-day color printers in order to automatically receive successive sheets of paper from a feed path and to clamp the leading edge of each sheet to a drum while the drum makes a plurality of revolutions as the sheet is being printed on and then to automatically release and eject the printed sheet to a discharge path prior to receiving the next sheet to be printed on. Those prior clamping mechanisms which do provide some automatic functions are complex devices requiring various gears and levers inside the body of the winding roll. This makes them relatively expensive to make and maintain. Also, some of the above-described prior clamping devices used for coiling metal strips clamp an excessive amount of the sheet material and sometimes distort that material. Accordingly, if they were incorporated into the drums of printing apparatus, they would disfigure the printed sheets.

SUMMARY OF THE INVENTION

Accordingly, the present invention aims to provide an improved drum clamping mechanism for clamping a sheet of paper or other flexible material to the drum or roll of printing apparatus.

Another object of the invention is to provide a mechanism of this type which will automatically receive successive sheets of paper from a feed path and clamp the leading edge of each sheet to a drum while the drum is rotated a plurality of revolutions during which a corresponding plurality of different colors are printed on the sheet and then will automatically release and eject the printed sheet to a discharge path prior to receiving the next sheet to be printed on from the feed path.

A further object of the invention is to provide a drum clamping mechanism which does not disfigure the sheet material being clamped to the drum.

Another object of the invention is to provide a drum clamping mechanism which is of relatively simple construction and which can be used with a roll of more or less standard design.

Yet another object of the invention is to provide a drum clamping mechanism which is relatively easy and inexpensive to manufacture and to service.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the mechanism of this invention is designed for use with a rotary drum or roll which is of more or less standard construction except for the presence of a single lengthwise radial slot in the surface of the drum or roll. The clamping mechanism includes a flanged clip which extends along the length of the drum and is slidably received in the drum slot. The clip is movable in the drum slot between a retracted clamping position wherein the clip flange engages the peripheral surface of the drum and an extended open position wherein the clip flange is spaced from drum surface so that a gap is present between the flange and that surface.

The clip is biased toward its retracted position and is moved to its extended position when the drum is in a selected angular position by cam means positioned adjacent to the drum. The cam means operate to engage and move the clip to its extended position when the drum rotates to a selected angular position, but only when the drum rotates in a given direction to that position. When the drum is rotated in the opposite direction to that selected position, the cam means do not extend the clip; rather the clip remains in its retracted position against the drum surface.

When incorporated into printing apparatus, the drum and its attendant clamping mechanism are positioned so that, when the drum is rotated to a selected angular position in the apparatus (hereinafter referred to as the release position), the cam means engage and extend the clip, creating a gap between the clip and the drum surface that is located directly in the feed path of paper sheets from a sheet source in the apparatus. That same gap lies opposite to a paper sheet discharge path in the apparatus which is different from the feed path.

Other parts of the printing apparatus include a print head positioned adjacent to the drum and drive means for rotating the drum in a first direction (referred to herein as the printing direction) and in a second direction opposite the first direction (denominated the release direction) and means for stopping the drum at a "top-of-sheet" position in which the clip is located adjacent to the print head and at the aforementioned release position in which the clip is located adjacent to the cam means. Of course, the printing apparatus also incorporates the usual controller for controlling the print head in synchronism with the rotation of the drum so that the print head prints high quality characters and lines on the paper sheet wrapped about the drum.

During operation of the printing apparatus, when the drum is stopped at its release position, the clip is extended forming the gap between the clip and the drum surface that receives the leading edge of a sheet advancing along the sheet feed path. Initially, the drive means rotate the drum in the release direction through a small angle. This causes the cam means to release the clip so that the clip retracts, thereby clamping the leading edge of the sheet to the drum surface. Then the drum is rotated to its top of sheet position so that the sheet is wrapped around the drum and carried to the top of sheet point opposite the print head. The drum is thereafter step-rotated in the print direction while the print head prints the first color on the sheet line by line until the printing of the first color is completed.

If a second color is to be printed on that same sheet, the drum is again rotated in the printing direction to the top of sheet point with the clip passing the cam means without being extended thereby. The drum is then step-rotated in that same, i.e. printing, direction while the print head prints the second color on the sheet. The cycling of the drum in the printing direction in this fashion is repeated for each color to be printed on the sheet. When printing is completed, after the drum is rotated in the printing direction to the top-of-sheet position, it is rotated in the opposite, i.e. release, direction to its release position. Whereupon, the cam means engage and extend the clip so that the printed sheet is ejected into the sheet discharge path leaving the extended or open clip ready to receive and clamp the next sheet being advanced along the feed path to the drum.

Thus, the present clamping mechanism is quite simple and can be incorporated into a more or less standard drum of the type used in printing apparatus of this general type. The mechanism is completely mechanical so that it clamps and releases each paper sheet reliably at exactly the right point in the printing cycle so that there is little chance of a malfunction in the transport of paper sheets to or from the drum. Further, as noted above, the clamping mechanism automatically accommodates itself to the number of different colors to be printed on each sheet wrapped about the drum. In other words, once a particular paper sheet is clamped to the drum, the mechanism will not release and eject that sheet to the sheet discharge path of the apparatus until all of the desired colors have been printed on that sheet. Thus, the mechanism meets all of the objectives desired for a clamping mechanism designed to secure a sheet to the rotary drum of a color printer which prints different colors on the sheet on successive passes of the sheet by a print head.

BRIEF DESCRIPTION OF THE DRAWING

For a fuller understanding of the nature and objects of the invention, reference should be had to the following detailed description, taken in connection with the accompanying drawing, in which:

FIG. 1 is a schematic diagram in cross section showing printing apparatus incorporating a drum clamping mechanism according to the present invention;

FIG. 2 is a fragmentary elevational view with parts cut away showing the FIG. 1 clamping mechanism in greater detail;

FIG. 3 is a sectional view along line 3—3 of FIG. 2; and

FIGS. 4A and 4B are fragmentary elevational views on a larger scale illustrating the operation of a portion of the FIG. 2 clamping mechanism.

DETAILED DESCRIPTION OF THE PRREFERRED EMBODIMENT

Referring to FIG. 1 of the drawing, color printing apparatus is indicated generally at 10. The apparatus includes a print head 12 and a plural color print ribbon cartridge 13 positioned opposite a rotary drum 14 that supports a paper sheet to be printed on by head 12. The leading edge of the sheet to be printed on is secured to drum 14 by a clip or clamp 16 incorporated into the drum. Clip 16, along with one or more cam asseblies 18 positioned adjacent to the drum at a selected angular location around its circumference, comprise the invention clamping mechanism. The illustrated apparatus 10 actually has two mirror-image cam assemblies 18 mounted adjacent to the opposite ends of the drum. These assemblies are located side by side at the underside of the drum; however, they could just as well be positioned at some other angle about the drum axis.

Still referring to FIG. 1, apparatus 10 also includes a paper sheet feed path in the form of a guide 22 for guiding a paper sheet S from a paper sheet source (not shown) in the direction of arrow 24 such that its leading edge is directed into clip 16 when the clip is located opposite cam assemblies 18 and is open as shown in solid lines in FIG. 1. Also present is a paper discharge path defined by a second guide 26 having one end adjacent to clip 16 when the drum 14 is oriented as in FIG. 1 to receive the paper sheet S as it is ejected from clip 16 in the direction of arrow 28 in a manner which will be described shortly. The print head 12, the cartridge 13, the sheet feeder and the means for controlling them in synchronism with the drum motion are not parts of the present invention. Therefore, they will not be described in detail here. For a full description of the structure and overall operation of apparatus 10, refer to co-pending application in the names of Jon S. Guy and Dean Yuan-Liu, Ser. No. 765,079, of even date herewith entitled THERMAL PRINTER, which application is owned by the assignee of the present application. It is enough to say here that drum 14 is rotatable in both directions by the drive means. Counterclockwise rotation as indicated by the arrow 32 in FIG. 1 shall be referred to as the "printing direction" and clockwise rotation as shown by arrow 34 in that same figure shall be referred to as the "release direction". When drum 14 is stopped by its drive means so that clip 16 is positioned opposite cam assemblies 18 as shown in solid lines in FIG. 1, the drum is deemed to be in its "release position". When rotating drum 14 in the printing direction of arrow 32, the drive means of apparatus 10 is also arranged to stop the drum in a so-called "top-of-sheet" position in which the clip 16 is located adjacent to the print head 12 as indicated by dot-dash lines in FIG. 1 so that the print head is positioned to print the first line on the paper sheet S.

The clip 16 on drum 14 is movable between a retracted clamping position shown in dotted lines in FIG. 1 (and also in FIG. 3) and an extended open position shown in solid lines in FIG. 1. The clip is biased toward its retracted position and normally remains in that position. It is moved to its extended position by cam assemblies 18 when drum 14 is rotated to its release position shown in FIG. 1, but only when the drum is rotated to that position in the release direction indicated by arrow 34 in that figure.

In describing the operation of apparatus 10, we will assume that drum 14 is stopped at its release position and clip 16 is in its open position adjacent cam assemblies 18 as shown in solid lines in FIG. 1. With the clip in that position, a gap 38 exists between the clip and the drum surface. Thus, when a paper sheet S is fed along guide 22 in the direction of arrow 24, its leading edge will be received in gap 38. After that occurs, drum 14 is rotated in the release direction indicated by arrow 34 through a small angle until clip 16 clears cam assemblies 18. Upon clearing assemblies 18, clip 16 moves to its retracted position so that it clamps the leading edge of sheet S to the drum. Then, the drum is rotated in the printing direction indicated by arrow 32 to its top-of-sheet position, so that sheet S is wrapped around the drum as indicated by the dot-dash lines in FIG. 1. The circumference of drum 14 is related to the length of sheet S and the placement of guide 26 such that, when the drum is in its top-of-sheet position, the trailing edge margin S' of sheet S rests on paper guide 26 as shown in in FIG. 1.

Apparatus 10 now commences the first printing sequence wherein the printing head 12 and cartridge 13 are actuated as drum 14 is step rotated in the printing direction shown by arrow 32 to print a first color on sheet S. When the last line is printed on the sheet, the drum continues rotating in the printing direction to the top-of-sheet position. With the ribbon in cartridge 13 having been advanced to print a second color on sheet S, the print head 12 is actuated and the drum 14 is once again step rotated in the printing direction to print the second color on the sheet. If additional colors are to be printed on the sheet, the drum 14 is cycled around to its top-of-sheet position and the print ribbon in cartridge 13 is advanced to the next color band thereon prior to printing each of those additional colors.

As long as the drum 14 is rotated in the printing direction through its release position, the cam assemblies 18 will not operate to extend clip 16. Accordingly, the leading edge of the sheet S remains clamped to the drum with the remainder of the sheet being held against the surface of the drum by print head 12 and guides 24 and 26. Furthermore, as noted above, each time the drum is rotated to its top-of-sheet position, a trailing edge margin S' of the sheet rests on the paper guide 26.

After all of the colors have been printed on the paper sheet, drum 14 is rotated once again to its top-of-sheet position placing the tail end S' of the sheet on guide 26 as shown in dotted lines in FIG. 1. Drum 14 is now rotated in its release direction shown by the dot-dash arrow 34 in FIG. 1 causing the sheet S wrapped around the drum to be pushed outward along the paper guide 26 in the direction of arrow 28. As the drum reaches its release position, clip 16 is engaged and moved to its extended position by cam assemblies 18 thereby releasing the leading edge of the sheet. The movement of the sheet carries it from gap 38 onto paper guide 26 for transport to the discharge point of the printing apparatus 10. It is important to note that clip 16 is only opened by cam assemblies 18 when drum 14 is rotated to its release position in the release direction of arrow 34. If this were not the case, the sheet S would be released as the print head 12 is printing on the sheet.

Referring now to FIGS. 2 and 3, the rotary drum 14 is of more or less standard construction having an axle 14*a* whose opposite ends are journaled in the apparatus frame 10*a*. The drum may be rotated by any conventional means (not shown). The drum is somewhat different from conventional ones of this general type in that it has a more or less radial slot extending along the length of the drum for slidably receiving clip 16. The clip is basically an elongated sheet metal blade having a generally L-shaped cross section. The long leg 16*a* of the clip is slidably received in slot 42. The clip short leg or flange 16*b* extends a short distance along the circumference of the drum. Preferably, a shallow lengthwise depression or recess 42*a* is provided in the drum surface adjacent to slot 42 so that, when the clip is retracted into slot 42, its leg 16*b* is more or less flush with the outer surface of the drum.

The clip leg 16*a* is formed with a pair of extensions 16*c* which overhang the opposite ends of drum 14. Each extension is slidably received in a slot 44 present between a pair of spaced-apart parallel blocks 46 mounted to the adjacent end of drum 14. Thus the extensions are slidably supported by their respective blocks 46 so that the clip can be moved in slot 42 between its retracted clamping position shown in FIGS. 2 and 3 and its extended open position shown in solid lines in FIG. 1.

The clip is biased toward its clamping position by a pair of coil springs 48 located at the opposite ends of the clip. Each spring 48 is stretched between a tab 16*d* projecting out laterally from the corresponding clip leg extension 16*c* and a pin 52 projecting out laterally from the nearby blocks 46 at the ends thereof adjacent the drum axle 14*a*. Springs 48 urge clip 16 to its clamping position so that the clip leg 16*b* is urged strongly against the floor of depression 42*a* in the drum surface as shown in FIG. 3.

In order to facilitate the movement of the clip to its open position by cam assemblies 18, a pair of lengthwise-extending pins 56 are mounted to the opposite ends of the clip so that they are positioned to be engaged by cam assemblies 18 when drum 14 is rotated through its release position. In the illustrated embodiment of the invention, each pin is located in the corner between the clip legs 16*a* and 16*b* and is welded or otherwise anchored there.

Referring now to FIGS. 2 and 4A, the pair of cam assemblies 18 comprising apparatus 10 are mounted to the apparatus frame 10*a* just beyond the opposite ends of drum 14 at the release position of the drum. As noted above, the assemblies are mirror images of one another. Each assembly includes a generally rectangular support plate 57 mounted by way of a spacer block 58 to the frame 10*a* so that, when the drum is at its release position shown in FIG. 2, plate 57 is spaced close to the end of the pin 56 at the corresponding end of clip 16.

The support plate 57 of each assembly 18 has a projection 62 adjacent its upper edge which functions as a cam stop. Positioned on block 57 below stop 62 is a lever arm 64 which is connected to the block by a pivot pin 66. A cam 68 is formed at one end 64*a* of arm 64 directly below projection 62. That end of the arm is biased against the projection 62 by a coil spring 72 stretched between the opposite end 64*b* of the lever arm and a pin 74 projecting from plate 57.

As best seen in FIG. 4A, each assembly 18 is positioned adjacent the end of the drum so that, when the drum is rotated to its release position in the printing direction indicated by arrow 32, the pin 56 projecting from the adjacent end of the clip 16 engages the upper surface 68*a* of cam 68 at a location proximal to the arm pivot 66. However, the lever arm 64 and cam 68 thereon are free to pivot downwards to provide clearance for the pin as the drum rotates through its release position in the printing direction. Accordingly, clip 16 is maintained in its retracted clamping position by springs 48 so that the leading edge of sheet S remains clamped to the drum as the sheet is carried around on the drum to the top-of-sheet position to commence the printing of a given color on the sheet.

When, however, as shown in FIG. 4B, the drum is rotated in its release direction indicated by arrow 34, as soon as the drum nears its release position, each clip pin 56 engages the undersurface of the cam 68 on the adjacent assembly 18 and exerts an upward force on its arm 64. However, upward movement of that arm is prevented by the associated cam stop projection 62 so that the clip pin 56 is forced to follow the cam undersurface. More particularly, each pin follows the downwardly inclined cam surface segment 68*b* so that the clip 16 is pulled progressively from its slot 42. By the time each pin 56 has advanced nearly to the end of its cam segment 68*b*, the clip is in its fully open position shown in solid lines in FIG. 1. At this point, the drive means stop the rotation of the drum so that the pins remain at the ends of segments 68*b*, thereby holding clip 16 in its open position to receive the leading edge of a sheet S. The sheet S on the drum which has been advancing along paper guide 26 as the drum has rotated in the release direction toward its release position is ejected from the gap 38 created when clip 16 opens so that the clip is now ready to receive a fresh paper sheet from the paper guide 22. At the beginning of the next printing cycle, after a new sheet is present in gap 38, drum 14 is first rotated in the release direction. This causes each clip pin 56 to slide onto and follow the cam surface segment 68*c* of the associated cam. Each of these segments is more or less perpendicular to the radius of drum 14. As soon as the pins clear segments 68*c*, the clip is urged to its closed position by springs 48 thereby clamping the new sheet to the drum. Immediately thereafter, the drum is rotated to its top of sheet position with pins 56 riding over the cam upper surfaces 68*a* as described above.

It will be seen from the foregoing then that the drum clamping mechanism disclosed herein provides a simple reliable means for clamping the leading edge of a sheet to a rotary drum for plural-color printing. Using wholly mechanical means, the mechanism permits the drum to rotate in its printing direction as many times as is required to print all the desired colors on the sheet wrapped around the drum. The mechanism releases the leading edge of the sheet on the drum only when the drum is rotated to its release position in the opposite or release direction in the process of discharging the printed sheet from the drum. The clamping mechanism is relatively inexpensive since it is composed of a relatively few metal parts which can be manufactured in quantity relatively inexpensively. The mechanism can be used with print drums and rollers of more or less conventional design, the only alteration required being the milling or forming of a small slot in the drum or roller. Thus, in some cases, it may even be possible to retrofit existing equipment with the clamping mechanism described herein. Also, since the clamping mechanism is completely mechanical, it does not contribute to energy-related costs of operating the printing apparatus in which it is incorporated.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. Drum clamping mechanism for a rotary printing drum having a surface for wrapping a sheet to be printed on, said drum having a first position which it assumes prior to printing on the sheet and a second position angularly displaced from the first position which it assumes after completion of printing on the sheet, said mechanism comprising A. clip means extending along the length of the drum for clamping the leading edge of a sheet to the drum surface;

B. means for movably mounting said clip means to the drum so that the clip means are movable between (1) an open position whereby a sheet-receiving gap is formed between said clip means and said drum surface, and (2) a clamping position whereby the leading edge of a sheet positioned between the clip means and the drum surface is clamped to the drum so that, when the drum is rotated in one direction, the sheet is wrapped about the drum;

C. means for urging the lip means to said clamping position;

D. uni-directionaly deflectable cam means; and

E. means for mounting the cam means adjacent to the drum at a selected angular position about the rotary axis of the drum so that when the drum is rotated to said second position in said one direction, said cam means are deflected by the engaging clip means which thereupon remain in their closed position, but when said drum is rotated to said second position in the direction opposite said one direction, said clip means are unable to deflect said cam means but are cammed thereby to said open position.

2. A drum clamping mechanism for a rotary printing drum having a surface for wrapping a sheet to be printed on, said drum having a first position which it assumes prior to printing on the sheet and a second position angularly displaced from the first position which it assumes after completion of printing on the sheet, said mechanism comprising A. clip means extending along the length of the drum for clamping the leading edge of a sheet to the drum surface;

B. means for movably mounting said clip means to the drum so that the clip means are movable between (1) an open position whereby a sheet-receiving gap is formed between said clip means and said drum surface, and (2) a clamping position whereby the leading edge of a sheet positioned between the clip means and the drum surface is clamped to the drum so that, when the drum is rotated in one direction, the sheet is wrapped about the drum;

C. means for urging the clip means to said clamping position;

D. cam means;

E. means for mounting the cam means adjacent to the drum so that the cam means are located opposite the clip means when the drum is in its second position; and F. coacting means on said clip means and said cam means which move said clip to said open position only when the drum is rotated to said second position in the direction opposite to said one direction, said coacting means including a. a uni-directionally deflectable cam member; and b. a portion of said clip means which engages said cam member (1) in the direction of its deflection when said drum is rotated in said one direction to said second position so that the clip means portion clears the cam member without moving the clip means to said open position, and (2) in a direction other than its direction of deflection when said drum is rotated in said opposite direction to said cam member moves the clip means to said open position.

3. The mechanism defined in claim 2 wherein

A. said drum surface has a lengthwise slot; and

B. said clip means are slidably received in said slot so that they extend and retract in said slot when moving between said open and clamping positions respectively.

4. The mechanism defined in claim 2 and further including means defining a sheet discharge path which A. is open to said gap when said drum is in its second position; and B. supports the trailing edge of a sheet clamped to said drum when the drum is rotated in said one direction to its first position so that, when the drum is thereafter rotated in said opposite direction to its second position to open the clip means, the sheet is discharged from the drum to the discharge path.

5. The mechanism defined in claim 4 and further including means for feeding the leading edge of a sheet into said gap when said drum is rotated in said opposite direction to said second position to open the clip means.

6. A drum clamping mechanism for a rotary printing drum having a surface for wrapping a sheet to be printed on, said surface having a lengthwise slot, said drum having a first position which it assumes prior to printing on the sheet and a second position angularly displaced from the first position which it assumes after completion of printing on the sheet, said mechanism comprising A. clip means extending along the length of the drum for clamping the leading edge of a sheet to the drum surface;

B. means for movably mounting said clip means to the drum so that the clip means are movable in said slot between (1) an extended position whereby a sheet-receiving gap is formed between said clip means and said drum surface, and (2) a retracted clamping position whereby the leading edge of a sheet positioned between the clip means and the drum surface is clamped to the drum so that, when the drum is rotated in one direction, the sheet is wrapped about the drum;

C. means for urging the clip means to said clamping position;

D. cam means;

E. means for mounting the cam means adjacent to the drum at a selected angular position about the rotary axis of the drum; and F. coacting means on said clip means and said cam means which move said clip to said open position only when the drum is rotated to said second position in the direction opposite to said one direction, said coacting means comprising (1) portions of said clip means adjacent to the opposite ends of the drum, and (2) a pair of cam assemblies which are positioned for engagement by the clip means portions when said drum is rotated to said second position, each said assembly including a deflectable cam member which deflects under the force applied by its engaging means clip portion when the drum is rotated in said one direction to its second position, and wedges against its engaging means clip portion when the drum is rotated in said opposite direction to its second position so as to move the clip means to said open position.

7. The mechanism defined in claim 6 wherein said cam means are located opposite said clip means when the drum is in its second position.

8. The mechanism defined in claim 6 wherein each cam assembly comprises

A. a support;

B. an arm pivotally mounted to the support to form a lever, said cam member being located at one end of said arm;

C. a stop member mounted to said support for stopping the pivoting motion of said arm; and D. spring means acting between said support and said arm to bias said arm toward said stop means.

9. A drum clamping mechanism for a rotary printing drum having a surface for wrapping a sheet to be printed on said drum having a first position which it assumes prior to printing and a second position angularly displaced from the first position which it assumes upon completion of printing, said mechanism comprising A. a clip slidably received in said slot so that it is movable between (1) an extended position so that a sheet-receiving gap is formed between said clip and the drum surface; and (2) a retracted position wherein the leading edge of a sheet positioned between the clip and the drum surface is clamped to that surface so that, when the drum is rotated in one direction, the sheet is wrapped about the drum;

B. spring means acting between said clip and said drum to bias said clip toward its retracted position; and C. a pair of mirror-image cam assemblies positioned at corresponding locations adjacent opposite ends of the drum at the second position of the drum, each said cam assembly including (1) support means;

(2) a cam member;

(3) means for mounting the cam member to the support means for limited movement in a direction away from said drum;

(4) stop means on said support means for limiting movement of said cam member toward said drum;

(5) means for biasing said cam member toward said stop means, said cam member being shaped so that, (a) when the drum is rotated in said one direction to its second position, the clip engages a surface of each cam member facing the drum axis and deflects the cam member away from said axis, and (b) when the drum is rotated in said opposite direction to said second position, the clip engages a surface of each cam member that faces away from the drum axis so that said clip is wedged away from the drum axis to its extended position.

10. The mechanism defined in claim 9 wherein said clip has a cross section which is generally L-shaped.

11. The mechanism defined in claim 9 and further including means defining a sheet discharge path which A. is open to said gap when said drum is in its second position; and B. supports the trailing edge of a sheet clamped to said drum when the drum is rotated in said one direction to its first position so that, when the drum is thereafter rotated in said opposite direction to its second position to open the clip, the sheet is discharged from the drum to the discharge path.

12. The mechanism defined in claim 11 and further including means for feeding the leading edge of a sheet into said gap after said drum is rotated in said opposite direction to said second position to open the clip.

* * * * *